US007136028B2

(12) United States Patent
Ramprasad et al.

(10) Patent No.: US 7,136,028 B2
(45) **Date of Patent: *Nov. 14, 2006**

(54) APPLICATIONS OF A HIGH IMPEDANCE SURFACE

(75) Inventors: Ramamurthy Ramprasad, Phoenix, AZ (US); Michael F. Petras, Phoenix, AZ (US); Chi Taou Tsai, Candler, AZ (US)

(73) Assignee: Freescale Semiconductor, Inc., Austin, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/927,921

(22) Filed: Aug. 27, 2004

(65) Prior Publication Data

US 2006/0044210 A1 Mar. 2, 2006

(51) Int. Cl.
*H01Q 15/02* (2006.01)

(52) U.S. Cl. ..... 343/909; 343/700 MS

(58) Field of Classification Search ..... 343/909, 343/700 MS, 753, 756
See application file for complete search history.

(56) References Cited

U.S. PATENT DOCUMENTS

| | | | | |
|---|---|---|---|---|
| 6,181,280 | B1 | 1/2001 | Kadambi et al. | |
| 6,285,325 | B1 | 9/2001 | Nalbandian et al. | |
| 6,483,480 | B1 | 11/2002 | Sievenpiper et al. | |
| 6,483,481 | B1 | 11/2002 | Sievenpiper et al. | |
| 6,545,647 | B1 * | 4/2003 | Sievenpiper et al. | 343/795 |
| 6,628,242 | B1 * | 9/2003 | Hacker et al. | 343/909 |
| 6,774,866 | B1 | 8/2004 | McKinzie, III et al. | |
| 6,906,682 | B1 * | 6/2005 | Alexopoulos et al. | 343/895 |
| 6,937,193 | B1 | 8/2005 | Hendler et al. | |
| 2003/0010529 | A1 | 1/2003 | Sievenpiper et al. | |
| 2005/0134521 | A1 * | 6/2005 | Waltho | 343/909 |

FOREIGN PATENT DOCUMENTS

WO WO 02/41447 A1 5/2002

OTHER PUBLICATIONS

Abhari, Ramesh, et al., "Metallo-Dielectric Electromagnetic Bandgap Structures for Suppression and Isolation of the Parallel-Plate Noise in High-Speed Circuits," IEEE Transactions on Microwave Theory and Techniques, vol. 51, No. 6, Jun. 2003.

Chen, Yi-Jan E., et al., "Investigation of Q Enhancement for Inductors Processed in BiCMOS Technology," IEEE, 1999, pp. 263-266.

Gardner, Donald, et al., "High Frequency (GHz) and Low Resistance Integrated Inductors Using Magnetic Materials," IEEE, 2001, pp. 101-103.

(Continued)

*Primary Examiner*—Hoanganh Le

(57) ABSTRACT

Disclosed herein are various high-impedance surfaces having high capacitance and inductance properties and methods for their manufacture. One exemplary high-impedance surface includes a plurality of conductive structures arranged in a lattice, wherein at least a subset of the conductive structures include a plurality of conductive plates arranged along a conductive post so that the conductive plates of one conductive structure interleave with one or more conductive plates of one or more adjacent conductive structure. Another exemplary high-impedance surface includes a plurality of conductive structures arranged in a lattice, where the conductive structures include one or more fractalized conductive plates having either indentions and/or projections that are coextensive with corresponding projections or indentations, respectively, of one or more adjacent conductive structures. Also disclosed are various exemplary implementations of such high-impedance surfaces.

16 Claims, 15 Drawing Sheets

OTHER PUBLICATIONS

Kamgaing, Telesphor, "High-Impedance Electromagnetic Surfaces for Mitigation of Switching Noise in High-Speed Circuits," PhD Dissertation Oral Defense submitted to the Faculty of the Graduate School of the University of Maryland, Oct. 15, 2003.

Kamgaing, Telesphor, "High-Impedance Electromagnetic Surfaces for Mitigation of Switching Noise in High-Speed Circuits," Dissertation submitted to the Faculty of the Graduate School of the University of Maryland, 2003.

Kamgaing, Telesphor, et al. "A Novel Power Plane with Integrated Simultaneous Switching Noise Mitigation Capability Using High-Impedance Surface," IEEE Microwave and Wireless Components Letters, vol. 13, No. 1, Jan. 2003.

Sievenpiper, Dan, et al., "High-Impedance Electromagnetic Surfaces with a Forbidden Frequency Band," IEEE Transactions on Microwave Theory and Techniques, vol. 47, No. 11, Nov. 1999.

Yang, Fei-Ran, et al., "A Uniplanar Compact Photonic-Bandgap (UC-PBG) Structure and Its Applications for Microwave Circuits," IEEE Transactions on Microwave Theory and Techniques, vol. 47, No. 8, Aug. 1999.

Yue, C. Patrick, et al., "On-Chip Spiral Inductors with Patterned Ground Shields for Si-Based RF IC's," IEEE Journal of Solid-State Circuits, vol. 33, No. 5, May 1998.

* cited by examiner

APPLICATIONS OF A HIGH IMPEDANCE SURFACE

CROSS-REFERENCE TO RELATED APPLICATIONS

The present application is related to co-pending U.S. patent application Ser. No. 10/927,944, filed herewith and entitled "Frequency Selective High Impedance Surface", the entirety of which is incorporated by reference herein.

FIELD OF THE INVENTION

The present disclosure relates generally to high-impedance surfaces and more particularly to frequency tunable high-impedance surfaces.

BACKGROUND OF THE INVENTION

A smooth-surfaced conductor typically has low surface impedance, which results in the propagation of electromagnetic (EM) waves at the surface of the conductor at higher frequencies. Upon reaching an edge, corner or other discontinuity, these surface waves radiate, or scatter, resulting in interference. The presence of such interference, therefore, is a cause for concern for high-frequency device designers using conductive materials, such as, for example, ground planes or reflectors for antennas, microstrip transmission lines, inductors, and the like.

In an effort to minimize the deleterious effects of surface waves on a conductor, various techniques have been developed whereby texture is implemented at the surface of the conductor. The texture may be provided by a lattice of conductive structures that extend away from the surface of the conductor. Conductors having this surface texture frequently are referred to as "high-impedance surfaces." The conductive structures of conventional high-impedance surfaces typically consist of a single metal plate, parallel to the surface of the conductor, and a metal post to connect the plate to the surface of the conductor. The metal post introduces an inductance proportional to its length while the capacitive coupling between the perimeters of adjacent conductive plates introduces capacitance to the surface of the conductor. The inductance and capacitance introduced by the lattice of conductive structures functions as a stop band filter that suppresses the propagation of surface waves within a stop band determined from the resonant frequency as defined by the inductance and capacitance introduced by the lattice of conductive structures. Accordingly, the conductive structures can be designed so as to achieve a stop band at the operational frequency of the high-frequency device, thereby minimizing the unwanted affects of the surface waves at the operational frequency. However, to achieve the inductance and capacitance necessary for a number of desirable operating frequency ranges, excessively large high-impedance surfaces often must be used due to the limited inductance and capacitance supplied by conventional conductive structures.

Accordingly, an improved high-impedance surface would be advantageous.

BRIEF DESCRIPTION OF THE FIGURES

The purpose and advantages of the present disclosure will be apparent to those of ordinary skill in the art from the following detailed description in conjunction with the appended drawings in which like reference characters are used to indicate like elements, and in which.

DETAILED DESCRIPTION OF PREFERRED EMBODIMENTS

The following description is intended to convey a thorough understanding of specific embodiments and details involving high-impedance surfaces. It is understood, however, that the present disclosure is not limited to these specific embodiments and details, which are exemplary only. It is further understood that one possessing ordinary skill in the art, in light of known systems and methods, would appreciate the use of the invention for its intended purposes and benefits in any number of alternative embodiments, depending upon specific design and other needs.

FIGS. 1–35 illustrate high-impedance surfaces and techniques for their implementation. In at least one embodiment, a high-impedance surface incorporates a lattice of conductive structures having two or more conductive plates substantially in parallel, where the conductive plates are interleaved with the conductive plates of one or more adjacent conductive structures in the lattice. In another embodiment, the perimeters of one or more conductive plates of the conductive structures may be fractalized, as described herein, so as to increase the capacitive coupling between the conductive structures or the conductive plates may take a spiral shape so as to increase the inductance introduced by the conductive structures. As discussed in detail below, such high-impedance surfaces may be utilized in a variety of devices whereby the ability to suppress surface waves in a ground plane or other conductor over a certain frequency band would be advantageous.

Figure 1:
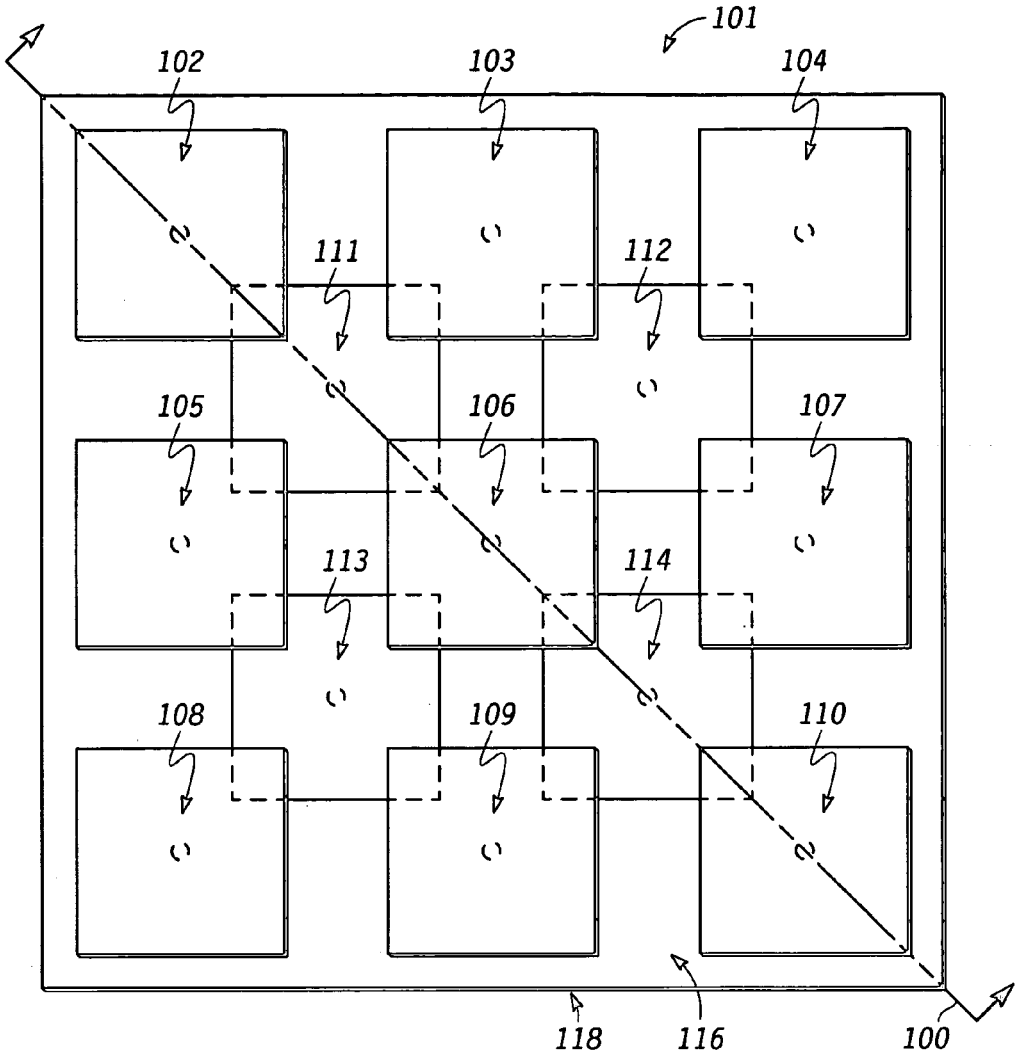
FIG. 1 is a top view illustrating an exemplary high-impedance surface in accordance with at least one embodiment of the present disclosure.

Referring now to FIGS. 1–4, a top view and alternate cross-section views (along line 100) of an exemplary high-impedance surface 101 are illustrated in accordance with at least one embodiment of the present disclosure. As FIG. 1 illustrates, the high-impedance surface 101 comprises a plurality of conductive structures 102–114 arranged in a lattice or similar pattern at or over the surface 116 of a conductor 118, such as conductive plane or ground plane. The conductive structures each comprise a conductive post (e.g., post 115 of conductive structure 102) electrically coupled to and extending from the surface 116 of the conductor 118 and having one or more conductive plates (e.g., plates 120 and 122 of conductive structure 102 of FIGS. 2–4) positioned toward the distal end of the post. In at least one embodiment, the conductive post extends substantially perpendicular from the surface 116 and the one or more conductive plates of the conductive structures are substantially parallel to the surface 116. The post and conductive plates may comprise any of a variety of conductive materials, such as, for example, copper, gold, aluminum, amorphous polysilicon, titanium nitride, or a combination thereof.

Although FIG. 1 depicts a high-impedance surface 101 having thirteen conductive structures for ease of illustration, those skilled in the art will appreciate that a high-impedance surface in accordance with the present disclosure may incorporate any number of conductive structures, such as a small number of conductors or even, hundreds, thousands, millions or billions of conductive structures arranged in a lattice, as appropriate. It will also be appreciated that although the conductive plates are illustrated as square-shaped in FIG. 1, as discussed in detail below, the conductive plates may be implemented as any variety of shapes or combination of shapes without departing from the spirit or the scope of the present disclosure.

Figure 2:
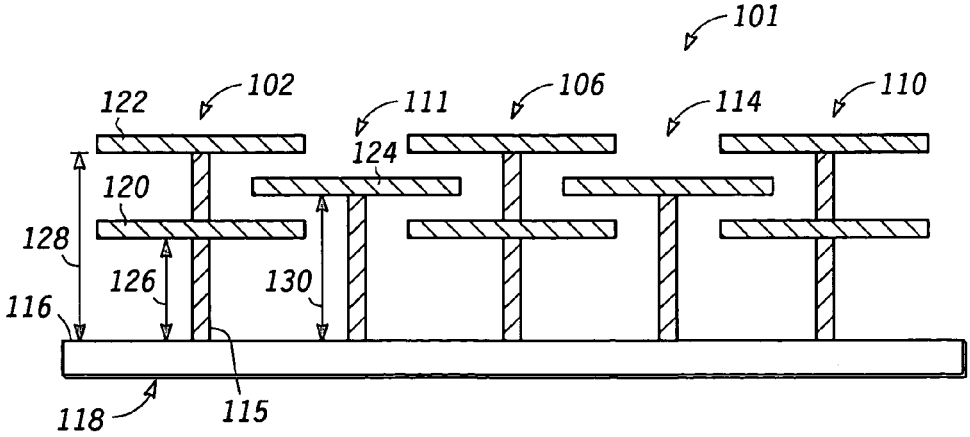
FIGS. 2–4 are alternate cross-section views of the exemplary high-impedance surface of FIG. 1 in accordance with at least one embodiment of the present disclosure.
Figure 3:
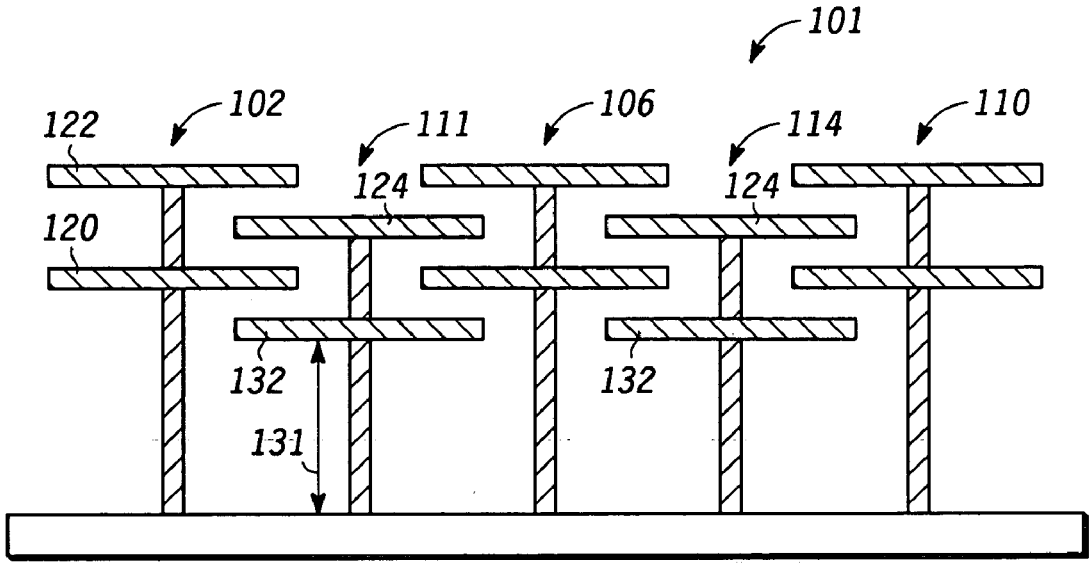
Figure 4:
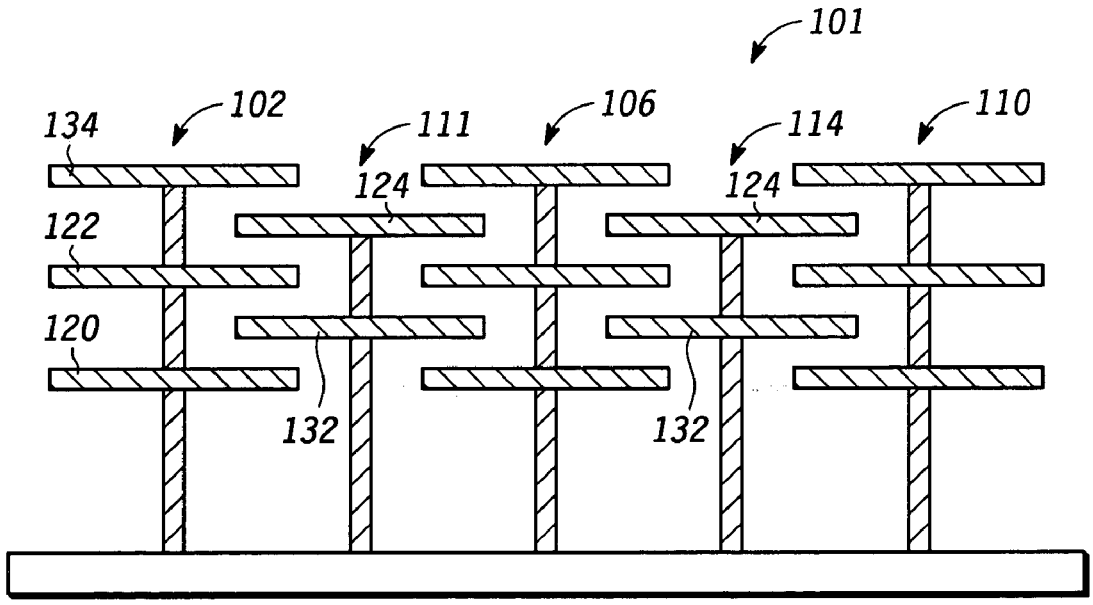

In at least one embodiment, the conductive plates of certain conductive structures may be positioned at different distances from the surface 116 than the conductive plates of other conductive structures so that the conductive plates of a conductive structure are interleaved with the conductive plates of one or more adjacent conductive structures. In the example of FIG. 2, conductive structures 102–110 each include two substantially parallel conductive plates 120 and 122, located at distances 126 and 128, respectively, from the surface 116, whereas conductive structures 111–114 each include a single conductive plate 124 located at a distance 130 from the surface 116, where the distance 130 is between distance 126 and 128 so that the conductive plate 124 of one of conductive structures 111–114 is interleaved with, or positioned between, the plates 120 and 122 of one or more adjacent conductive structures 102–110. In the example of FIG. 3, conductive structures 111 and 114 each include two substantially parallel conductive plates 124 and 132, where the conductive plate 132 is located at a distance 131 from the surface 116, the distance 131 being less than the distance 130. Accordingly, the plates 120 and 122 of conductive structures 102–110 may be interleaved with the conductive plates 124 and 132 of one or more adjacent conductive structures 111–114. In the example of FIG. 4, conductive structures 102–110 include three substantially parallel conductive plates 120, 122 and 134 which interleave with the conductive plates 124 and 132 of one or more adjacent conductive structures 111–114.

As FIGS. 2–4 demonstrate, the use of multiple conductive plates on a conductive structure and the varying distances of the conductive plates of adjacent conductive structures from the surface 116 results in overlap between the conductive plates of adjacent conductive structures. This overlap results in capacitive coupling between the conductive structures. Thus, the distance between overlapping plates, the degree to which the conductive plates overlap or the distance between overlapping plates, and the size of the plates each may be adjusted or designed so as to tune the high-impedance surface to achieve a desired capacitance.

Figure 5:
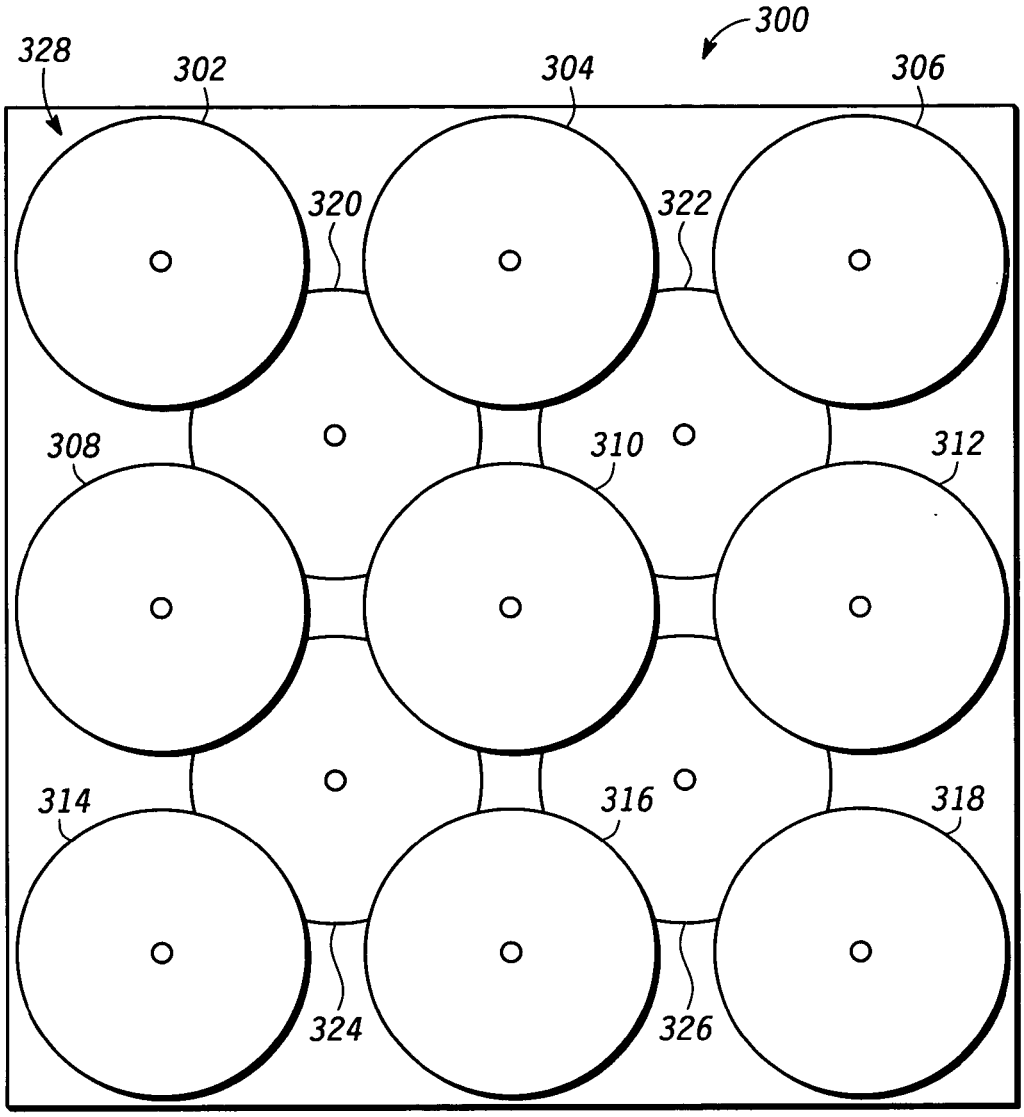
FIGS. 5–7 are top views illustrating exemplary high-impedance surfaces in accordance with at least one embodiment of the present disclosure.
Figure 6:
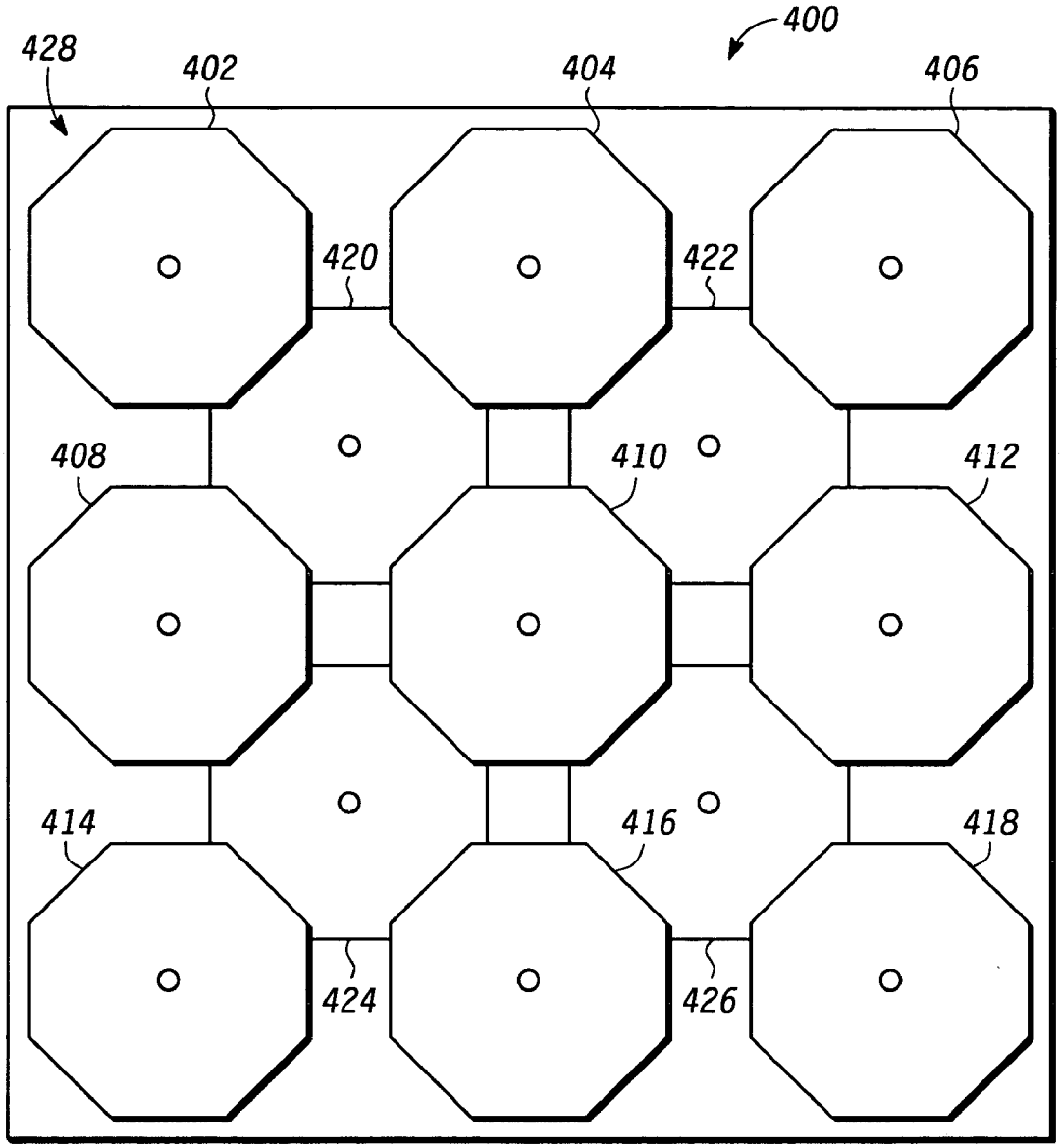

Referring now to FIGS. 5 and 6, top views of exemplary high-inductance surfaces 300 and 400, respectively, are illustrated in accordance with at least one embodiment of the present disclosure. As noted above, the conductive plates may take any of a variety of forms. For example, the high-inductance surface 300 of FIG. 5 may comprise a plurality of conductive structures 302–326 having substantially circular conductive plates 328. Similarly, as another example, the high-inductance surface 400 of FIG. 6 comprises a plurality of conductive structures 402–426 having octagon-shaped conductive plates 428.

Moreover, in at least one embodiment, certain conductive structures of a high-impedance surface may have conductive plates with a first shape and other conductive structures of the lattice may have conductive plates with a second shape, a third shape and so forth. Also, the shapes of the conductive plates may vary within a conductive structure. For example, a conductive structure could include a circle-shape conductive plate, a square-shaped conductive plate and a hexagon-shaped conductive plate located at different positions along the length of the conductive post.

Figure 7:
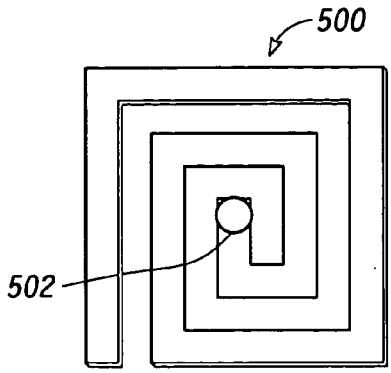
Figure 8:
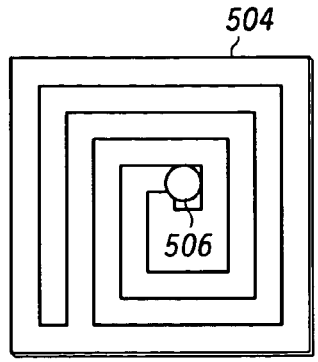
FIGS. 8 and 9 are top views illustrating various exemplary conductive plates for use in high-impedance surfaces in accordance with at least one embodiment of the present disclosure.
Figure 9:
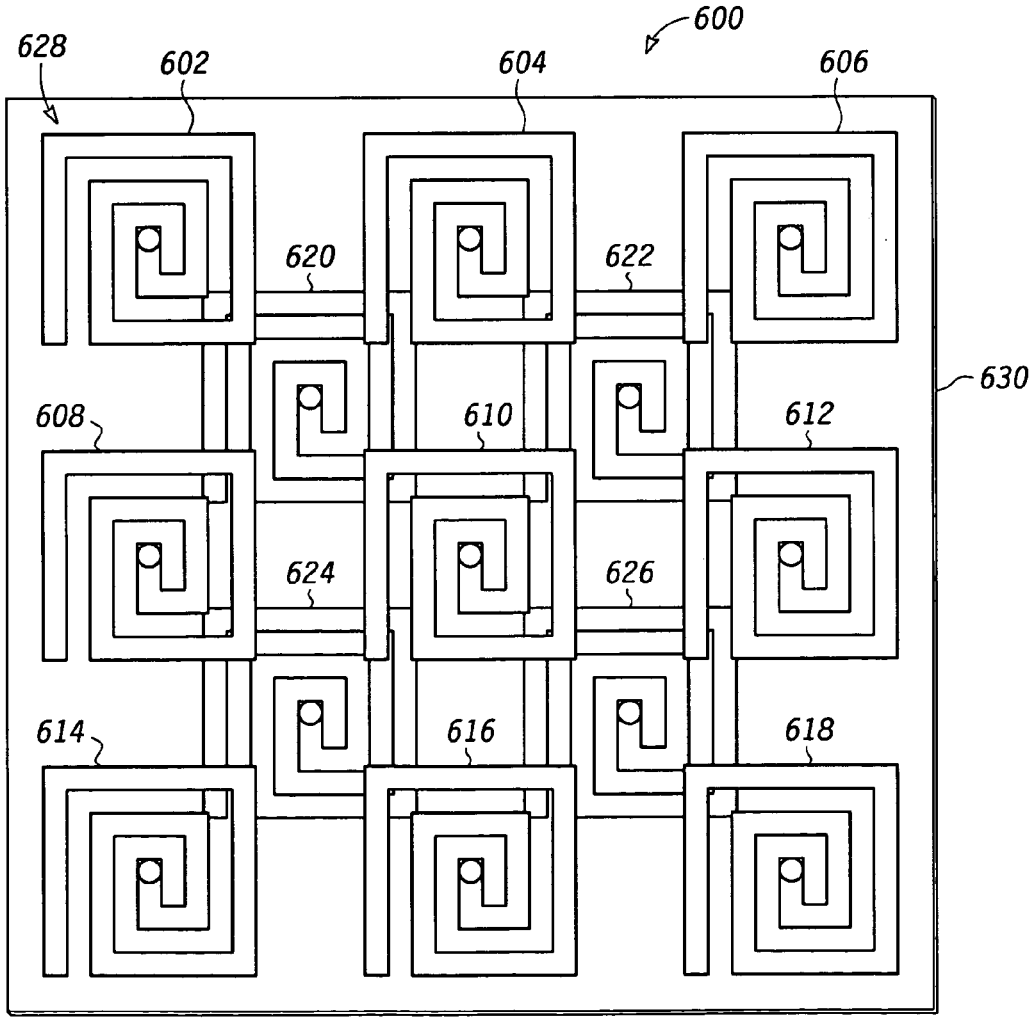

Referring now to FIGS. 7–9, additional exemplary implementations of conductive plates for use in high-impedance surfaces are illustrated in accordance with at least one embodiment of the present disclosure. As noted above, the inductance introduced by conventional surface texturing techniques typically is directly proportional to the length of the conductive post between the single conductive plate and the surface of the conductor. Accordingly, to introduce a significant amount of inductance using conventional surface texturing techniques, conductive structures with excessively long posts and/or an excessive number of conventional conductive structures generally are necessary. However, in one embodiment of the present disclosure, the conductive plates themselves may be configured as inductors so as to introduce additional inductance, thereby reducing or eliminating the need for long posts or a high number of conductive plates to achieve a desired inductance. FIG. 7 illustrates a top view of an exemplary conductive structure having a conductive plate 500 electrically coupled to a conductive post 502 and having an open spiral shape and FIG. 8 illustrates a top view of an exemplary conductive structure having a conductive plate 504 electrically coupled to a conductive post 506 and having an a closed spiral shape. From their spiral shapes, it will be appreciated that conductive plates 500 and 504 may introduce appreciable inductance in the presence of a high-frequency signal in the conductor to which the conductive structures are attached. This additional inductance may be used to compensate for shorter conductive posts compared to conventional conductive structures having the same frequency response characteristics, or this additional inductance may be used to achieve a frequency response unattainable by high-impedance surfaces employing conventional conductive structures of similar dimensions.

FIG. 9 illustrates an exemplary high-impedance surface 600 having a plurality of conductive structures 602–626 electrically coupled to and arranged in a lattice on the surface 628 of a conductor 630, the conductive structures 602–626 employing, for example, one or more of the open-spiral conductive plates 500 of FIG. 6. As similarly discussed above with reference to FIGS. 1–4, the conductive structures 602–626 may employ multiple conductive plates that interleave with the conductive plates of adjacent conductive structures. The multiple conductive plates may include other spiral-shaped plates or a combination of spiral-shaped plates and plates having other shapes, such as a solid square, circle, triangle, and the like. Although the conductive structures 602–626 are illustrated as being positioned so that their conductive plates overlap one or more conductive plates of one or more adjacent conductive structures, in an alternate embodiment, some or all of the conductive structures 602–626 may be positioned so that their conductive plates confront, but do not overlap, the conductive plates of one or more adjacent conductive structures.

Figure 10:
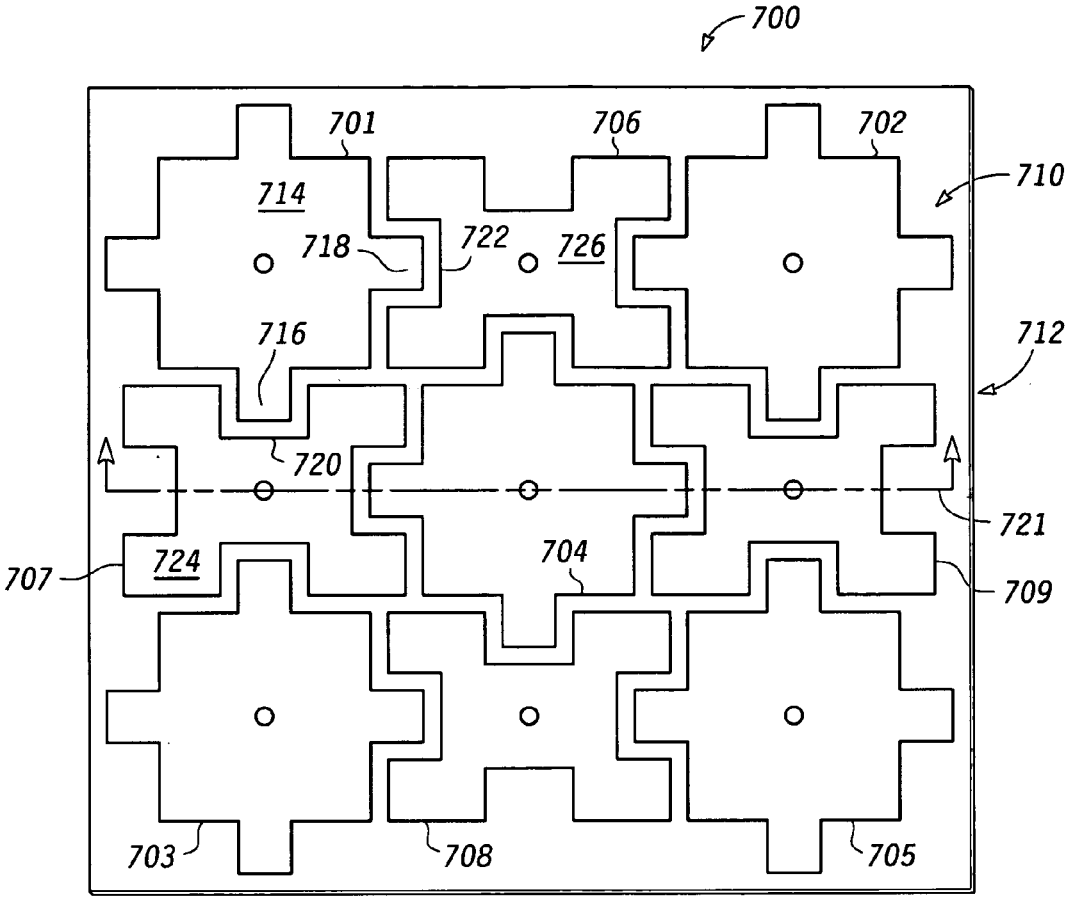
FIG. 10 is a top view illustrating an exemplary high-impedance surface having fractalized conductive plates in accordance with at least one embodiment of the present disclosure.
Figure 11:
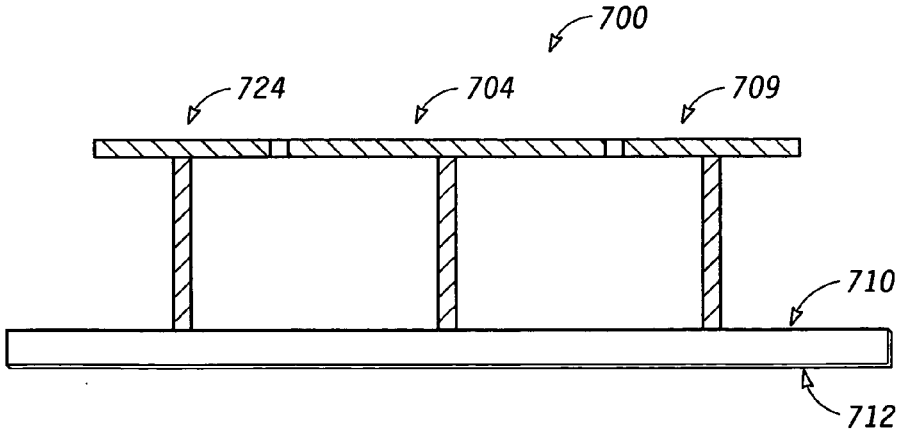
FIG. 11 is a cross-section view illustrating the exemplary high-impedance surface of FIG. 10 in accordance with at least one embodiment of the present disclosure.

Referring now to FIGS. 10 and 11, an additional exemplary high-impedance surface 700 having fractalized conductive plates is illustrated in accordance with at least one embodiment of the present disclosure. FIG. 10 depicts a top view of the high-impedance surface 700 having a plurality of conductive structures 701–709 electrically coupled to and arranged in a lattice on a surface 706 of a conductor 708, wherein conductive structures 706–709 are interspersed between conductive structures 701–705, and vice versa. FIG. 11 depicts a cross-section view of the high-impedance surface 700 along line 721.

A majority of the capacitance introduced by the conductive structures of high-impedance surfaces generally is a result of the capacitive coupling between the edges of conductive plates of adjacent conductive structures. As described above, one exemplary technique for increasing this capacitance is by interleaving multiple conductive plates of adjacent conductive structures so that the conductive plates overlap one or more plates of one or more adjacent conductive structures. Another exemplary technique for increasing the capacitance involves increasing the overall perimeters of the conductive plates that confront other conductive plates so as to increase the overall capacitive edge coupling without significantly increasing the total area of the conductive plates. In the illustrated embodiment of FIGS. 10 and 11, this increased perimeter length is achieved by "fractalization" of the conductive plates, whereby indentations present in the edge of one conductive plate correlate to protrusions in the edge of an adjacent conductive plate so that the protrusions of an edge of one conductive plate are substantially coextensive with, or positioned in, the corresponding indentations in the edge of one or more adjacent conductive plates. To illustrate, conductive structure 701 may be configured with a conductive plate 714 having protrusions 716 and 718 at its perimeter which are substantially coextensive with indentions 720 and 722 at the perimeter of the conductive plates 724 and 726 of conductive structures 707 and 706, respectively. As a result of the use of protrusions and corresponding indentations at the perimeters of the plates of adjacent conductive structures, the total length of the confronting edges of the plates may be increased compared to conductive plates with linear, or non-fractalized, edges for the same general dimensions. As the total lengths of the adjoining edges are greater than the lengths of adjoining edges with a non-fractalized conductive plate, fractalized conductive plates typically introduce more capacitance as a result of increased capacitive edge coupling. Accordingly, the degree of fractalization (e.g., the size, shape or number of projections or indentations) of the conductive plates may be tuned to achieve a particular desired capacitance.

Figure 12:
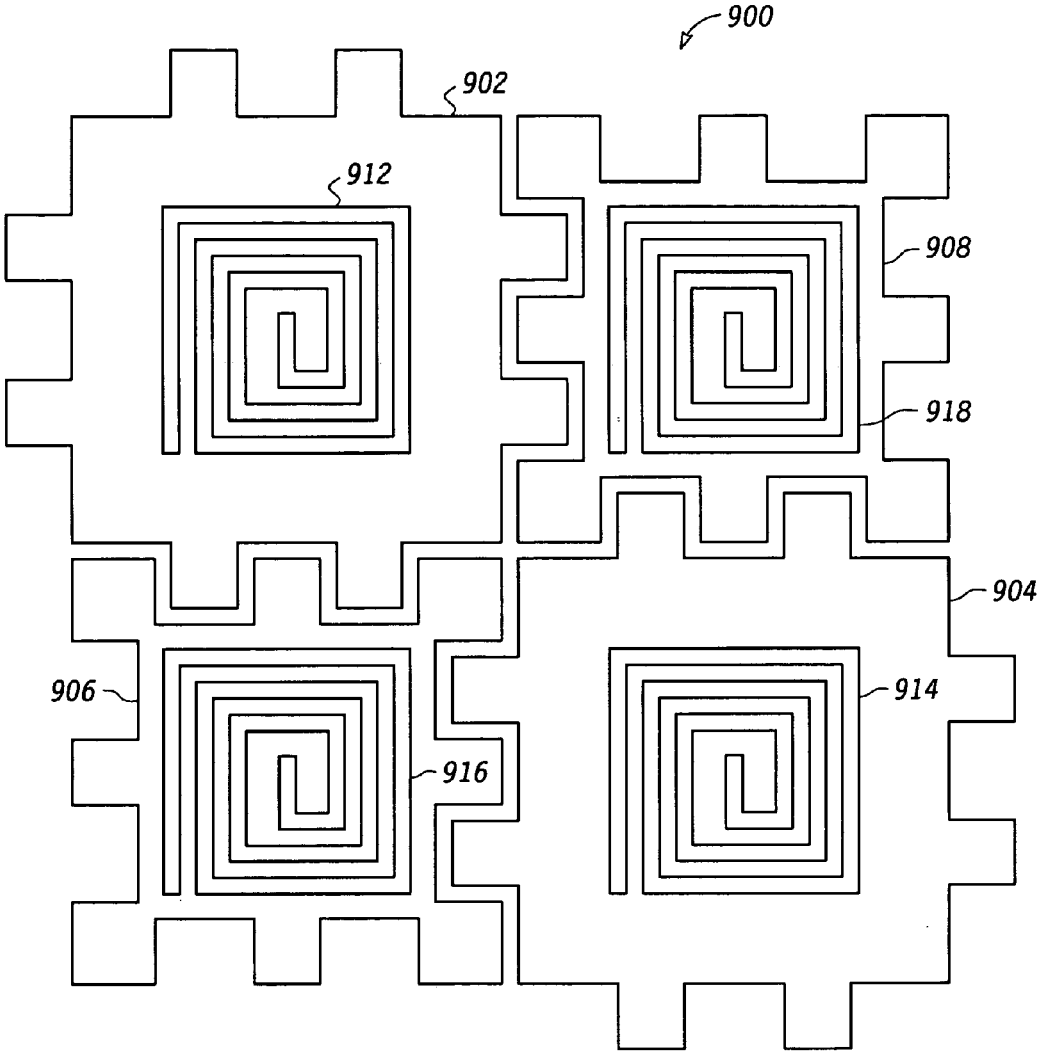
FIG. 12 is a top view of an exemplary high-impedance surface employing conductive plates with fractalized perimeters and inductive portions in accordance with at least one embodiment of the present disclosure.

Referring now to FIG. 12, top view of a portion of an exemplary high-impedance surface 900 having a lattice of conductive structures with fractalized and inductive conductive plates 902–908 is illustrated in accordance with at least one embodiment. As noted above, various conductive plate features disclosed herein may be advantageously combined. The high-impedance surface 900 is one example whereby the perimeters of the conductive plates 902–908 are fractalized with indentions and projections that correspond to and are coextensive with the projections and indentions of the conductive plates of adjacent conductive structures so as to introduce additional capacitive coupling. In addition, portions 912–918 of conductive plates 902–908, respectively, have a spiral shape so as to introduce additional impedance into the high-impedance surface 900.

Figure 13:
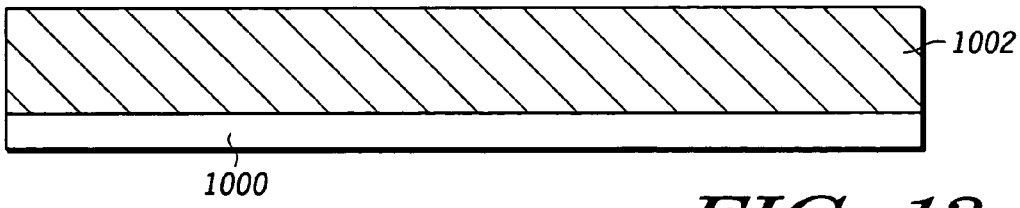
FIGS. 13–24 are cross-section views illustrating various stages of an exemplary manufacture of a high-impedance surface in accordance with at least one embodiment of the present disclosure.

Referring now to FIGS. 13–24, an exemplary method for manufacturing a high-impedance surface including conductive structures with multiple plates is illustrated in accordance with at least one embodiment of the present disclosure. FIGS. 13–28 depict a cross-section view of a high-impedance surface at various stages of its manufacture. For ease of discussion, the exemplary method is discussed in the context of the formation of a ground plane for use in silicon-based devices. However, those skilled in the art may utilize the disclosed techniques for implementation in other types of devices using the guidelines provided herein. In FIG. 13, a layer 1002 of dielectric material, such as FR-4, polyamide, ceramic, etc., is formed on or positioned at the surface of a ground plane 1000 (one embodiment of a conductor), where the thickness of the dielectric layer 1002 corresponds to the resulting distance of the first conductive plates from the ground plane 1000 as discussed below.

Figure 14:
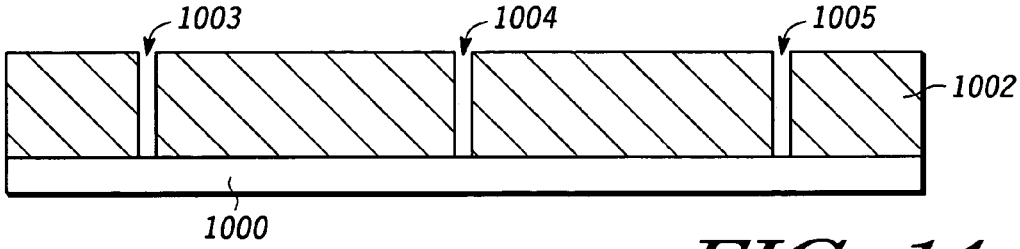

In FIG. 14, a first set of vias 1003–1005 are formed in the dielectric layer 1002 so as to extend to the surface of the ground plane 1000. The first set of vias 1003–1005 correspond to the posts of a first set of conductive structures of a lattice of conductive structures to be formed at the high-impedance surface.

Figure 15:
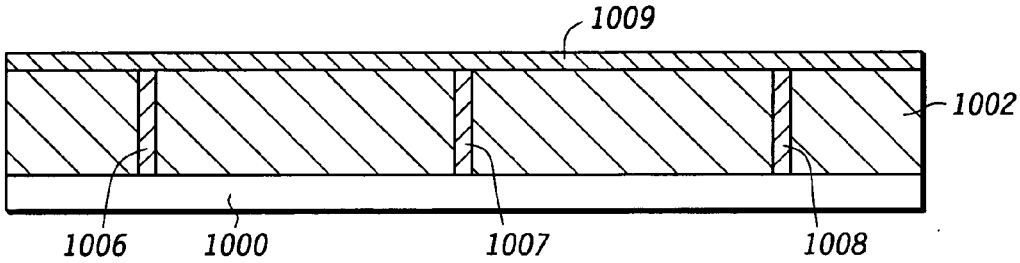

In FIG. 15, the first set of vias 1003–1005 are plated or filled with a conductive material to form the conductive posts 1006–1008 and a layer 1009 of conductive material is formed on or positioned at the surface of the dielectric layer 1002 such that the conductive layer 1009 is electrically coupled to the posts 1006–1008. The layer 1009 may comprise any of a variety of suitable conductive materials, such as, for example, aluminum, copper, gold, titanium nitride, etc.

Figure 16:
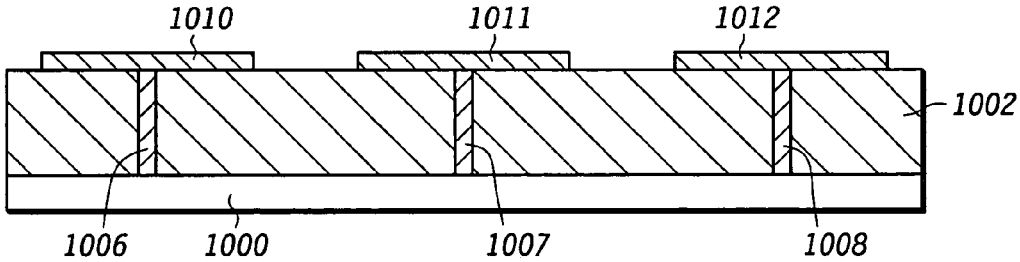

In FIG. 16, portions of the layer 1009 are removed (via, e.g., photolithic etching or laser trimming), so as to form conductive plates 1010–1012 electrically coupled to conductive posts 1006–1008, respectively.

Figure 17:
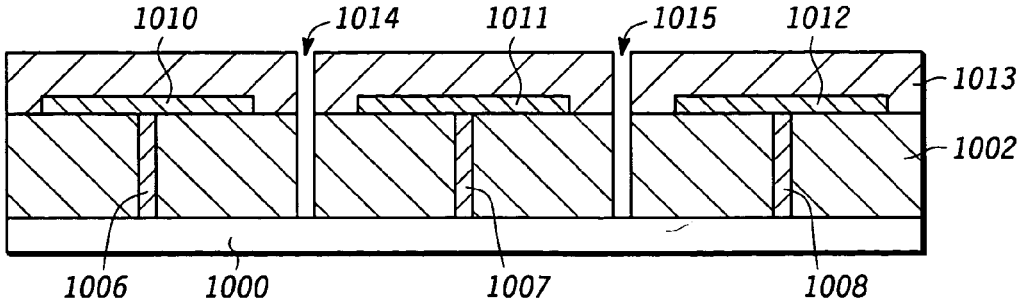

In FIG. 17, a second dielectric layer 1013 is formed on or positioned over the conductive plates 1010–1012 and the dielectric layer 1002 and a second set of vias 1014 and 1015 are formed in the dielectric layers 1002 and 1013 so as to extend to the surface of the ground plane 1000. The second set of vias 1014 and 1015 correspond to the posts of a second set of conductive structures of the lattice of conductive structures to be formed at the high-impedance surface.

Figure 18:
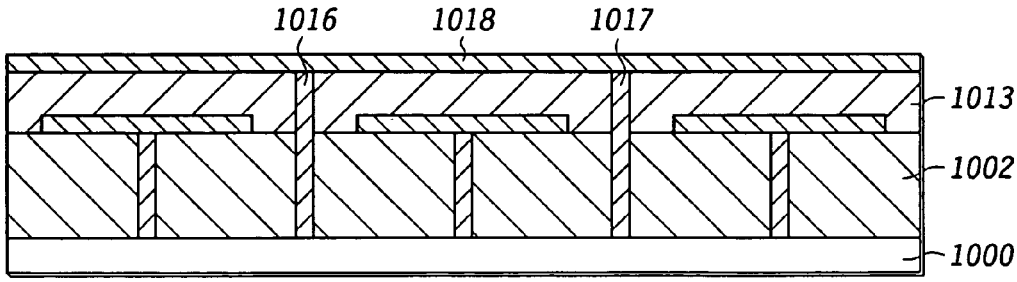

In FIG. 18, the second set of vias 1014 and 1015 are plated or filled with a conductive material to form first portions of conductive posts 1016 and 1017 and a second conductive layer 1018 is formed on or positioned at the second dielectric layer 1013 so that the conductive posts 1016 and 1017 are electrically coupled to the second conductive layer 1018.

Figure 19:
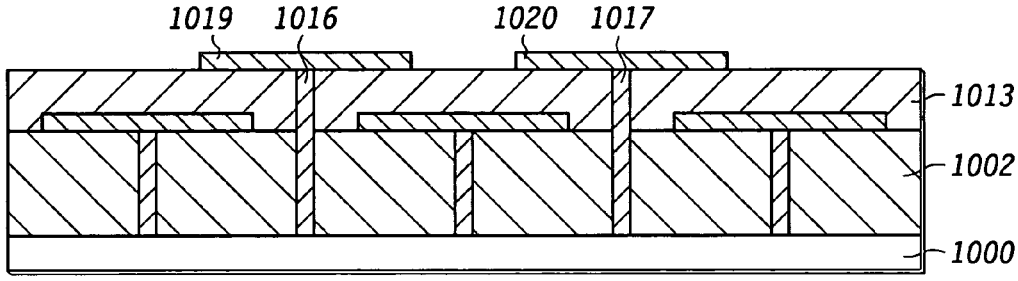

In FIG. 19, portions of the second conductive layer 1018 are removed to form conductive plates 1019 and 1020 electrically coupled to conductive posts 1016 and 1017, respectively.

Figure 20:
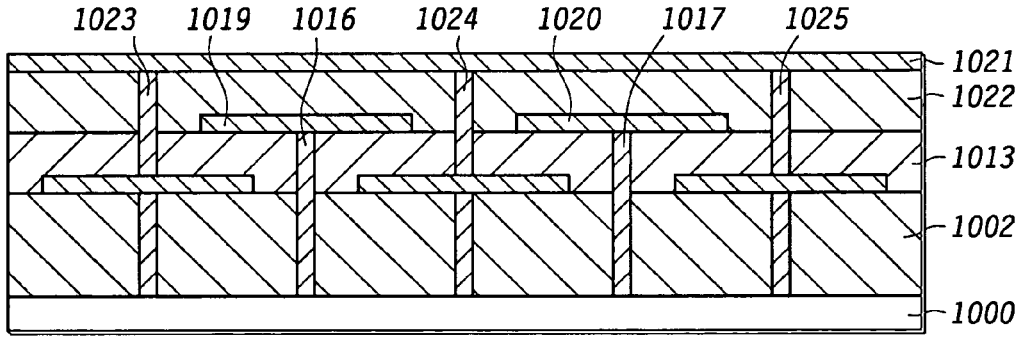

In FIG. 20, a third dielectric layer 1022 is formed on or positioned at the conductive plates 1019 and 1020 and the second dielectric layer 1013. Vias 1023–1025 are formed in the dielectric layers 1012 and 1022 so as to extend to the conductive plates 1010–1012, respectively. The vias 1023–1025 then may be plated or filled to form second portions of the conductive posts 1006–1008. A third conductive layer 1021 is formed on or positioned at the surface of the third dielectric layer 1022 so as to be electronically coupled to the conductive posts 1006–1008.

Figure 21:
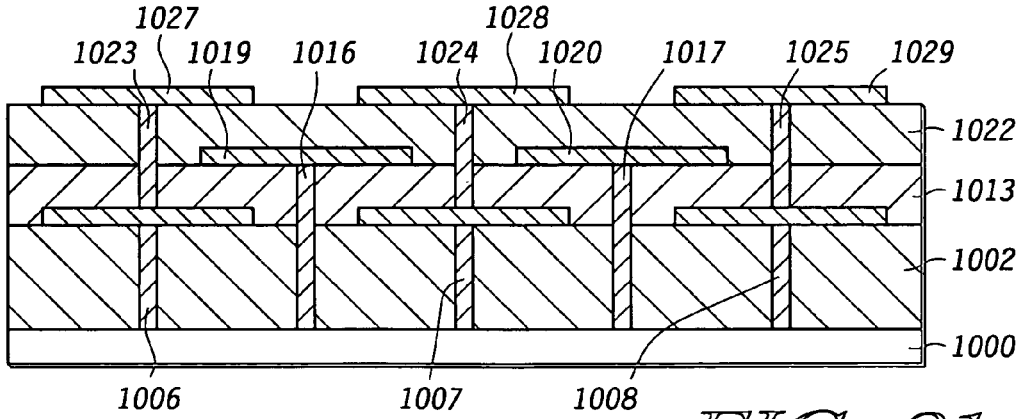

In FIG. 21, portions of the third dielectric layer 1021 are removed so as to form conductive plates 1027–1029 electrically coupled to conductive posts 1006–1008, respectively.

Figure 22:
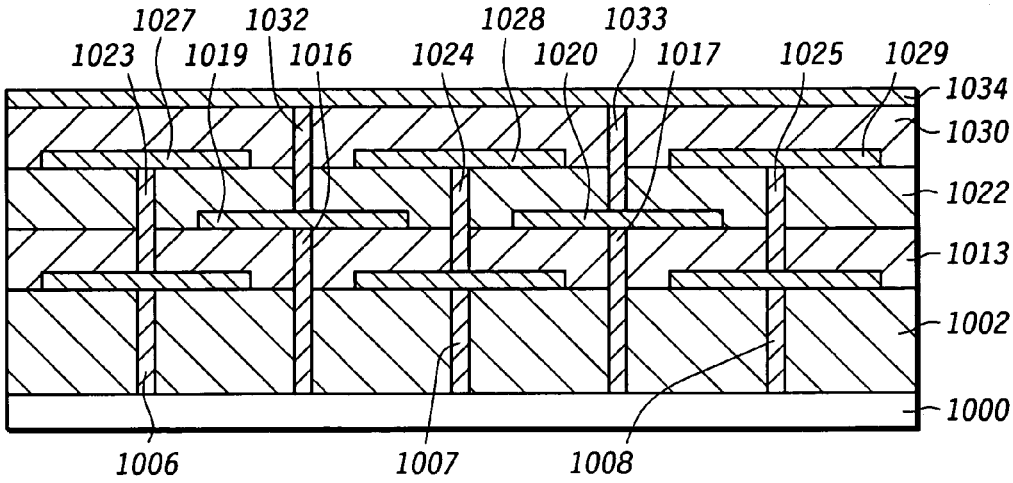

In FIG. 22, a fourth dielectric layer 1030 is positioned or formed on the conductive plates 1028–1029 and the third dielectric layer 1022. Vias 1032 and 1033 are formed in the dielectric layers 1022 and 1030 so as to extend to the conductive plates 1019 and 1020. The vias 1032A and 1032B then may be plated or filled with conductive material to form second portions of conductive posts 1014 and 1015. A fourth conductive layer 1034 then may be formed or positioned over the fourth dielectric layer 1030 so that the conductive layer 1034 is electrically coupled to the conductive posts 1014 and 1015.

Figure 23:
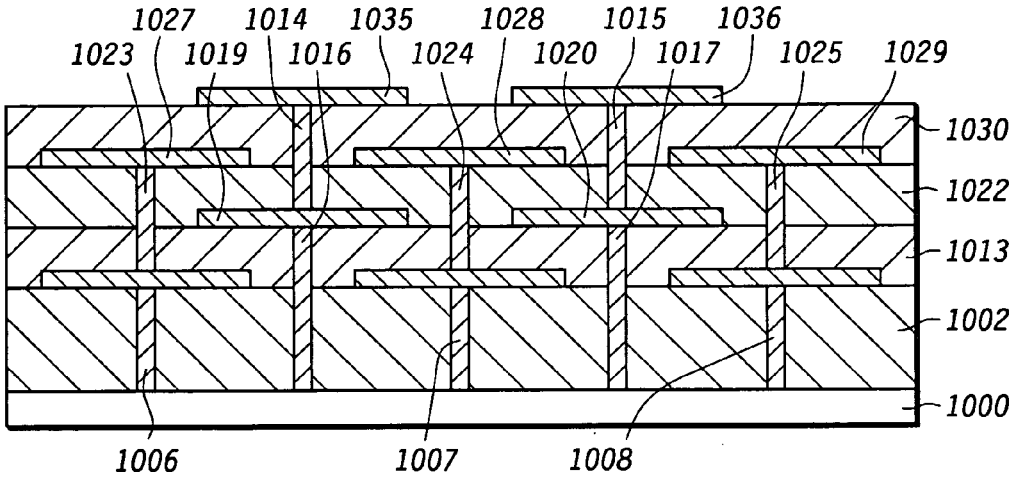

In FIG. 23, portions of the fourth dielectric layer 1034 are removed to form conductive plates 1035 and 1036 electrically coupled to conductive posts 1014 and 1015, respectively.

Figure 24:
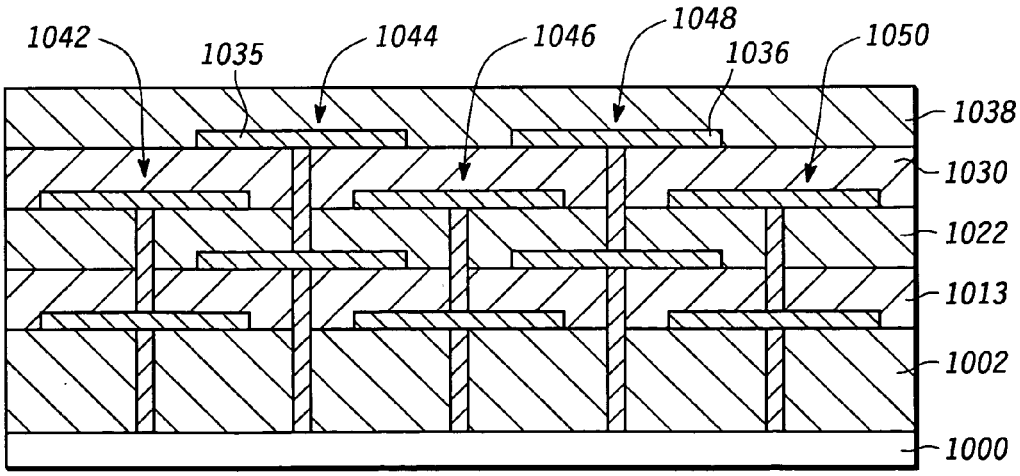

In FIG. 24, a fifth dielectric layer 1038 may be formed on or positioned at the conductive plates 1035 and 1036 and the fourth dielectric layer 1030.

As illustrated, the resulting high-impedance surface 1040 includes a plurality of conductive structures 1042–1050 electrically coupled to the ground plane 1000, where the conductive structures 1042–1050 each include two substantially parallel conductive plates that are interleaved with and overlap the conductive plates of at least one adjacent conductive structure. The degree of overlap, the shape, size or the fractalization of the conductive plates may be tuned to achieve the desired capacitance. Likewise, the height of the posts and the characteristics of spiral portions in the conductive plates may be tuned to achieve a desired inductance.

Referring now to FIGS. 25–28, an exemplary method for manufacturing a high-impedance surface using a low temperature ceramic co-fired (LTCC) technique is illustrated in accordance with at least one embodiment of the present invention. Typical LTCC techniques involve forming individual layers of a circuit substrate using ceramic material and then joining the individual layers by applying heat, usually using a type of oven. In at least one embodiment, such LTCC techniques may be employed to manufacture a high-impedance surface as described herein.

Figure 25:
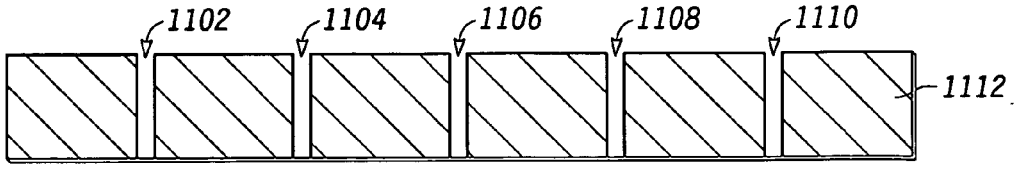
FIGS. 25–28 are cross-section views illustrating various states of an exemplary low temperature ceramic co-fired manufacture of a high-impedance surface in accordance with at least one embodiment of the present disclosure.
Figure 26:
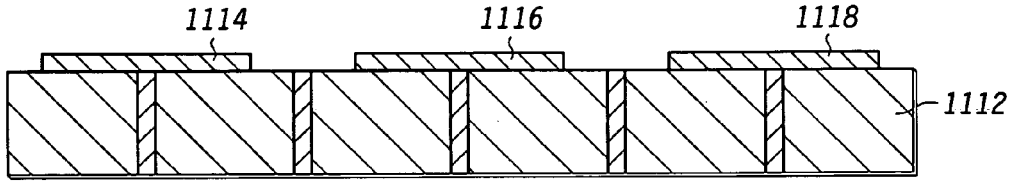

For each layer or substrate of a high-impedance device, holes and metalizations may be formed to provide the conductive features of that layer. Referring to FIG. 25, for example, holes 1102–1110, corresponding to portions of posts of conductive structures may be formed in a layer 1112 of ceramic material, such as ceramic paste. In FIG. 26, the holes 1102–1110 may be filed or plated with conductive material and plates 1114–1118 may be formed at the surface 1120 of the ceramic layer 1112, where the plates 1114–1118 each are electrically coupled to one of the metallized holes 1102–1110.

Figure 27:
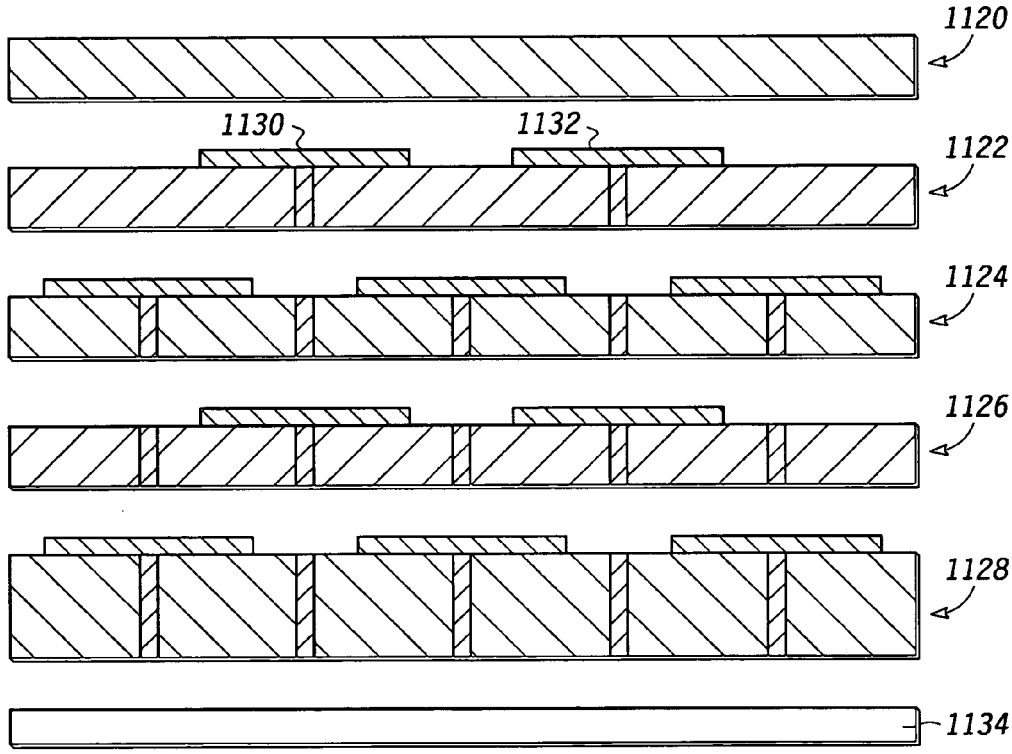

Each layer of the high impedance surface may be separately formed in a similar manner. For example, FIG. 27 depicts an exemplary manufacture whereby layers 1120–1128 each are separately formed with their corresponding post portions and conductive plates. In the illustrate example, layer 1120 may include a ceramic layer without any metalizations so as to electrically insulate the plates 1130 and 1132 formed on layer 1120. In one embodiment, the layers 1120–1128 are placed together along with a conductor 1134 and subjected to heat. The heat causes the ceramic material of one layer to fuse with adjacent layers, thereby forming the high-impedance surface 1140 illustrated in FIG. 28.

Figure 28:
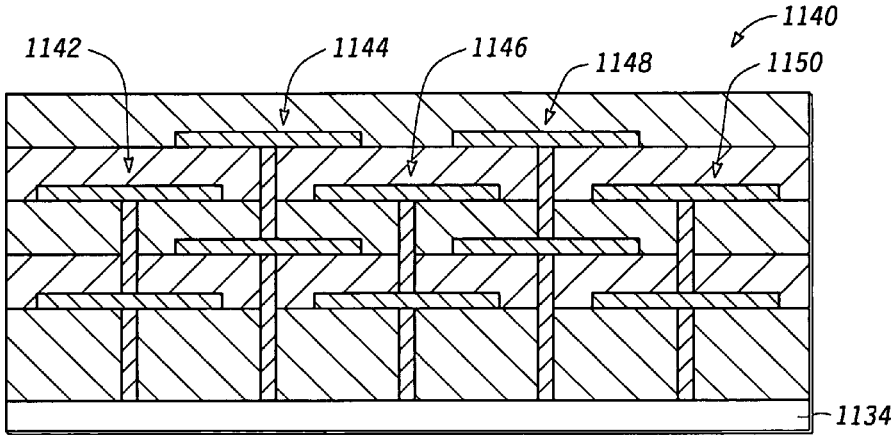

As depicted by FIG. 28, the resulting high-impedance surface 1140 includes a plurality of conductive structures 1142–1150 electrically coupled to the conductor 1134, where the conductive structures 1142–1150 each include two substantially parallel conductive plates that are interleaved with and overlap the conductive plates of at least one adjacent conductive structure. The degree of overlap, the shape, size or the fractalization of the conductive plates may be tuned to achieve the desired capacitance. Likewise, the height of the posts and the characteristics of spiral portions in the conductive plates may be tuned to achieve a desired inductance.

Figure 29:
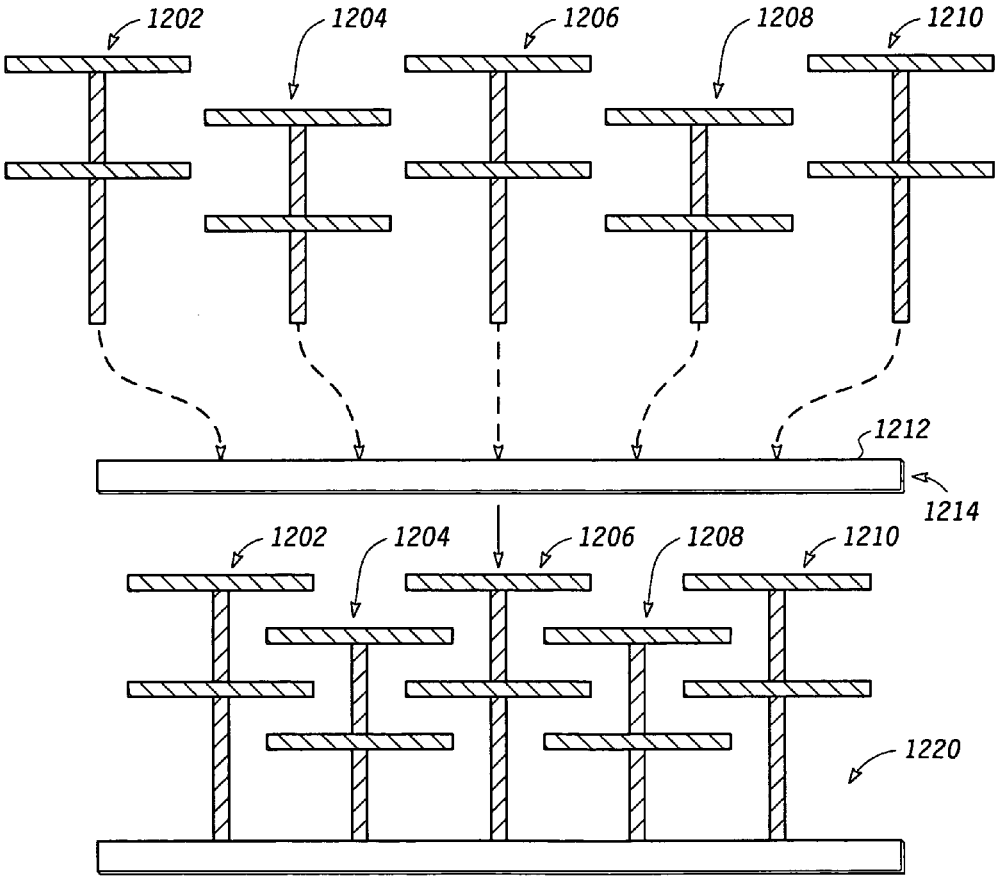
FIG. 29 is a cross-section view illustrating an exemplary technique for manufacturing a high-impedance surface in accordance with at least one embodiment of the present disclosure.

Referring now to FIG. 29, another exemplary method for manufacturing a high-impedance surface is illustrated in accordance with at least one embodiment of the present disclosure. In the illustrated embodiment, a plurality of conductive structures 1202–1210 are preformed and include one or more conductive plates electrically coupled to a conductive post. To facilitate the interleaving of conductive plates between adjacent conductive structures, the respective positions of conductive plates along the corresponding posts are arranged so that the conductive plates of one conductive structure are positioned above, below or between the conductive plates of adjacent conductive structures when coupled to the surface 1212 of a conductor 1214. For example, conductive structures 1202, 1206 and 1210 may have two conductive plates that are at a first distance and a second distance from the end of their conductive posts, whereas conductive structures 1204 and 1208 may have two conductive plates at third and fourth distances from the end of their conductive posts, where the third distance is less than the first distance and the fourth distance is between the first and second distances in the illustrated example.

The preformed conductive structures 1202–1210 then may be attached to corresponding positions at the surface 1212 of the conductor using any of a variety of attachment techniques, such as welding, solder reflow, the use of conductive adhesive, and the like, resulting in a high-impedance surface 1220 having a lattice of conductive structures with interleaved conductive plates. The conductive structures 1202–1210 may remain uncovered, using air as the dielectric between the conductive plates, or the conductive structures 1202–1210 may be surrounded or covered by a liquid or solid dielectric material.

Referring now to FIGS. 30–35, various exemplary implementations of the high-impedance surfaces disclosed above are illustrated in accordance with at least one embodiment of the present disclosure. As noted above, high-impedance surfaces exhibit two properties: 1) the suppression of surface waves and surface currents within the stop band frequency range; and 2) the reflection of magnetic energy within the stop band frequency range. These properties may be advantageously used to enhance the operation of any of a variety of high-frequency conductive devices. Moreover, the high-inductance surfaces disclosed herein provide for improved frequency tunability as well as smaller dimensions compared to conventional high-impedance surfaces, which may permit the use of smaller high-impedance surfaces with finer frequency response. The high-inductance surfaces discussed with reference to FIGS. 30–32 preferably include high-inductance surfaces manufactured or configured in accordance with one or more the high-inductance surface techniques and structures disclosed above with reference to FIGS. 1–29.

Figure 30:
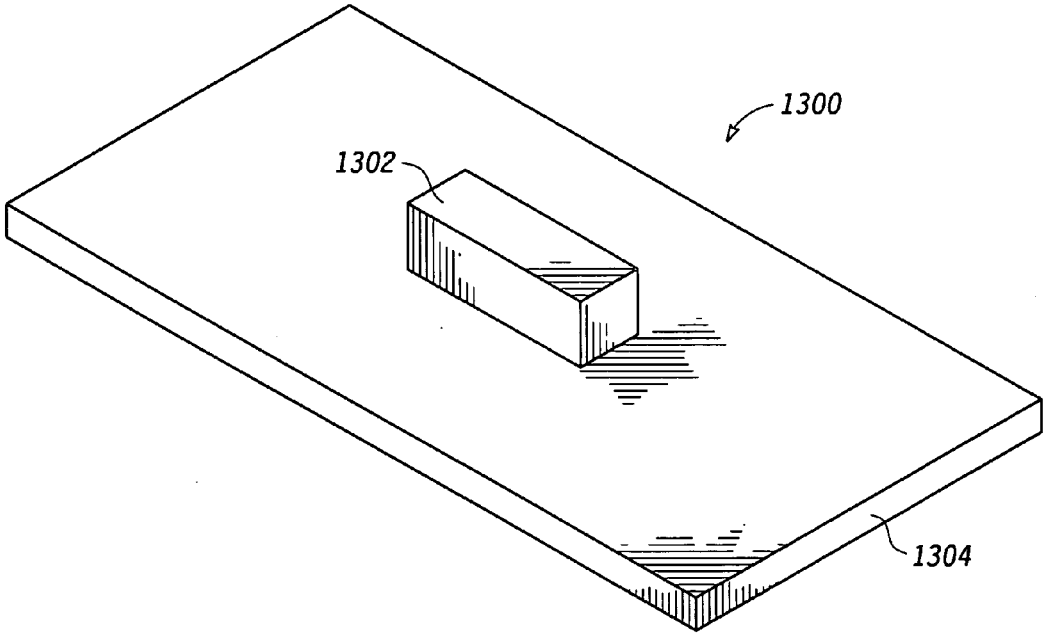
FIG. 30 is a perspective view illustrating an exemplary device comprising an inductor disposed adjacent to a high-impedance ground plane in accordance with at least one embodiment of the present disclosure.
Figure 31:
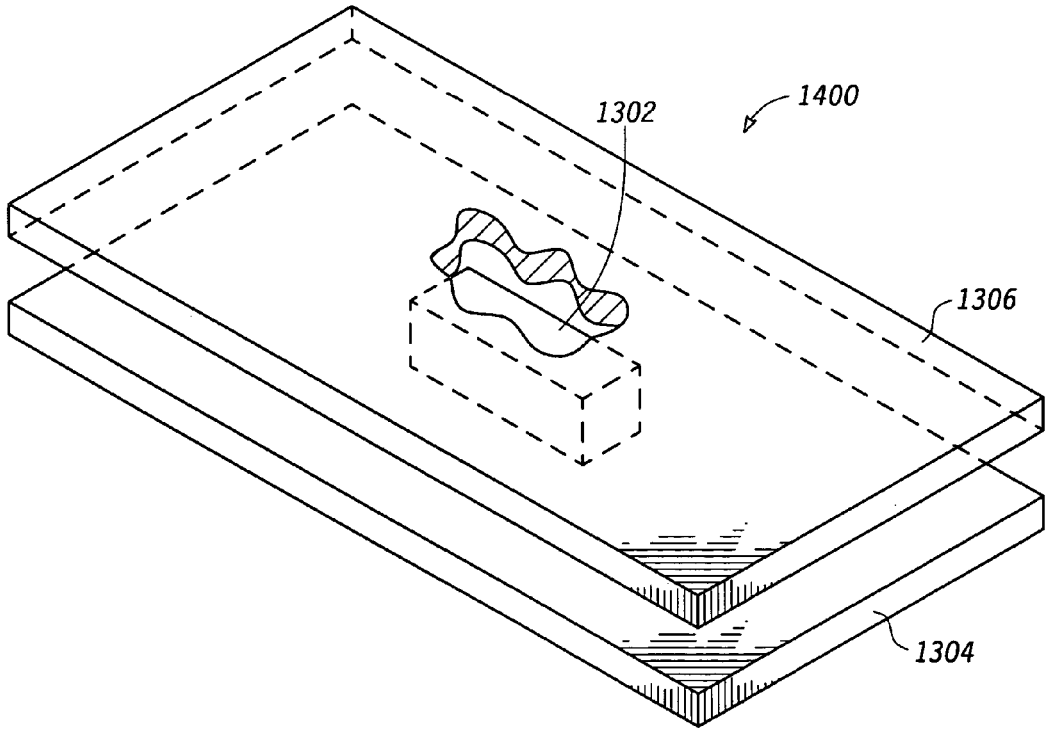
FIG. 31 is a perspective view illustrating an exemplary device comprising an inductor disposed between two high-impedance ground planes in accordance with at least one embodiment of the present disclosure.

FIG. 30 illustrates one exemplary implementation of a high-impedance surface in accordance with one embodiment of the present disclosure. The illustrated apparatus 1300 includes an inductor 1302 positioned adjacent to a high-impedance surface 1304. The high-impedance surface 1304 preferably includes a lattice of conductive structures having fractalized conductive plates, multiple interleaved conductive plates, inductive (e.g., spiral-shaped) plates, or a combination thereof. FIG. 31 illustrates a similar apparatus 1400 having the inductor positioned between two high-impedance surfaces 1304 and 1306.

A typical property of the high-impedance surfaces 1304 and 1306 is that a portion of the magnetic energy emitted by the inductor 1302 within the stop band of the high-impedance surface is reflected back toward the inductor 1302. Accordingly, the total inductance of the inductor 1302 in the presence of the single high-impedance surface 1304 is $L+|M|$, where L is the natural inductance of the inductor 1302 and M represents that mutual coupling between the inductor 1302 and its reflected image from the high-impedance surface 1304, which in turn is dependent on the distance between the inductor and the high-impedance surface. In a similar manner, the total inductance of the inductor 1302 in the presence of the two high-impedance surfaces 1304 and 1306 of apparatus 1400 is the sum of the natural inductance L of the inductor 1302 and the reflected images $M_1$ to $M_i$ resulting from the high-impedance surfaces 1304 and 1306. Because the high-impedance surfaces 1304 and 1306 confront each other with the inductor 1302 in between, theoretically there would be an infinite number of reflected images (i.e., i=infinity), resulting in an infinite inductance. In practice, however, the total inductance is much less, but still considerably larger than the natural inductance of the inductor 1302. Accordingly, the use of one or more high-inductance surfaces adjacent to an inductor enhances the quality (Q) factor of the inductor, thereby allowing a smaller or less expensive inductor to be utilized.

Figure 32:
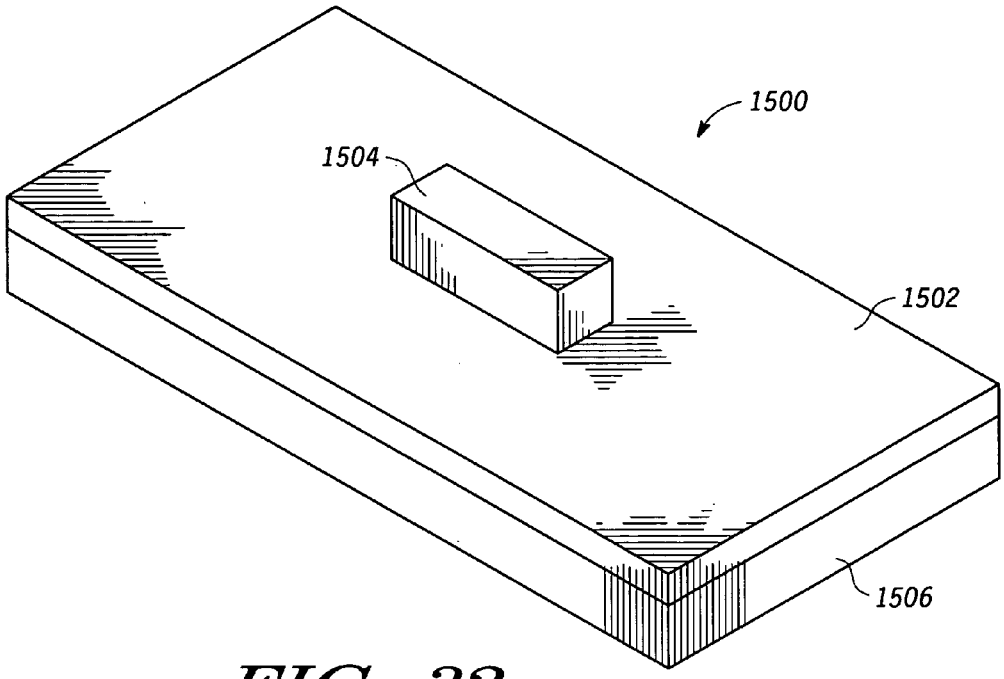
FIG. 32 is a perspective view illustrating an exemplary device comprising a high-impedance surface to shield active components from an inductor in accordance with at least one embodiment of the present disclosure.

FIG. 32 illustrates an exemplary apparatus 1500 wherein a high-impedance surface 1502 may be used as an electromagnetic (EM) shield between an EM-emitting conductive device 1504, such as an inductor, on or near a first side of the high-impedance surface 1502 and one or more active components of a substrate 1506. In this instance, the high-impedance surface 1502 may be tuned so that its stop band overlaps the operating frequency of the EM-emitting device 1504, thereby reducing or eliminating EM surface waves along the high-impedance surface 1502. By reducing or eliminating the surface waves, the EM noise introduced into the substrate 1506 is suppressed.

Figure 33:
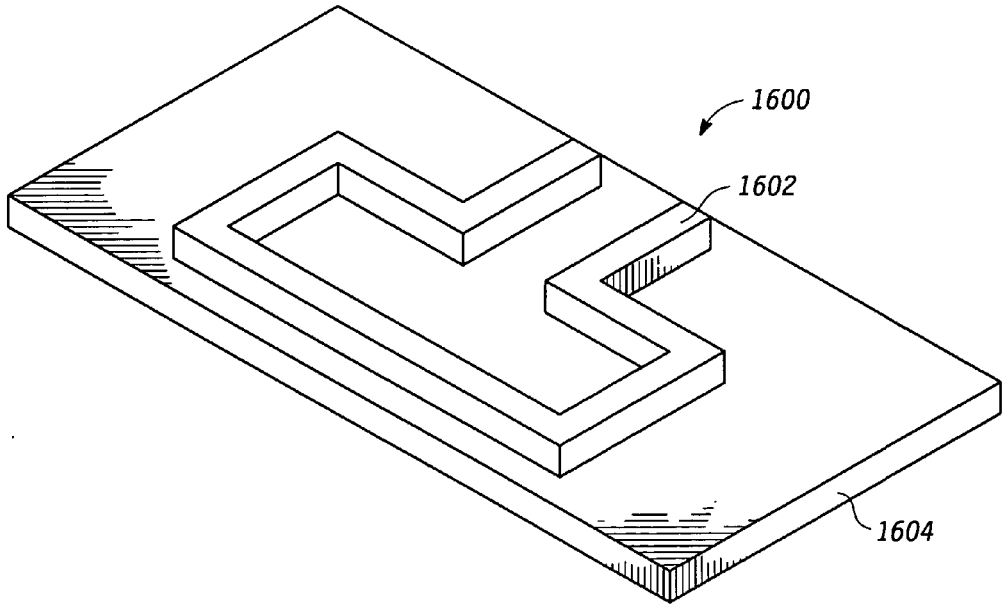
FIG. 33 is a perspective view illustrating an exemplary device comprising an antenna disposed adjacent to a high-impedance surface in accordance with at least one embodiment of the present disclosure.

FIG. 33 illustrates an exemplary device 1600 comprising an antenna 1602 disposed at or near the surface of a high-impedance surface 1604, where the high-impedance surface 1604 acts as a reflector or a ground plane for the antenna 1602. The high-impedance surface 1604 may be tuned so that its stop band correlates to the operating frequency of the antenna 1602. Thus, the high-impedance surface 1604 may reflect the radiation from the antenna 1602 back to the antenna 1602 (typically resulting in a 3 dB gain), while reducing or eliminating the noise or interference that otherwise would result from the radiation of surface waves into free space as would occur in a typical ground plane or reflector. Moreover, because the high-impedance surfaces of the present disclosure display greater capacitive coupling and inductance than conventional high-impedance surfaces having similar dimensions, a smaller high-impedance surfaced 1604 may be used as the ground plane or reflector for the antenna 1602, which achieving the same surface wave suppression characteristics.

Figure 34:
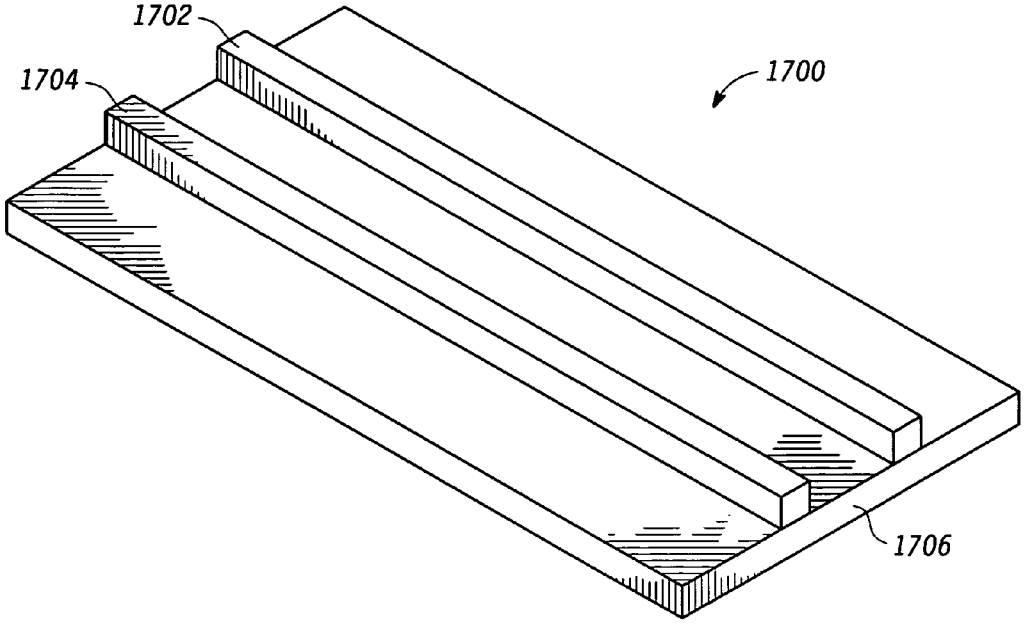
FIG. 34 is a perspective view illustrating an exemplary device comprising differential signaling lines disposed adjacent to a high-impedance surface in accordance with at least one embodiment of the present disclosure.

FIG. 34 illustrates an exemplary apparatus 1700 comprising differential transmission lines 1702 and 1704 disposed at or near a high-impedance surface 1706 in accordance with at least one embodiment of the present disclosure. In typical differential transmission scenarios, two emanating signals result from the transmission of reflective information signals over paired differential transmission lines. One signal, the differential mode signal, typically facilitates the accurate transmission of the information signals via the differential transmission lines. The other signal, the common mode signal, typically results in significant interference in the transmission of the information signals. However, in the presence of the high-impedance surface 1706, surface waves resulting from the transmission of signals via the transmission lines 1702 and 1704 are reduced or eliminated, which in turn suppresses the undesirable common mode signal between the transmission lines 1702 and 1704.

Figure 35:
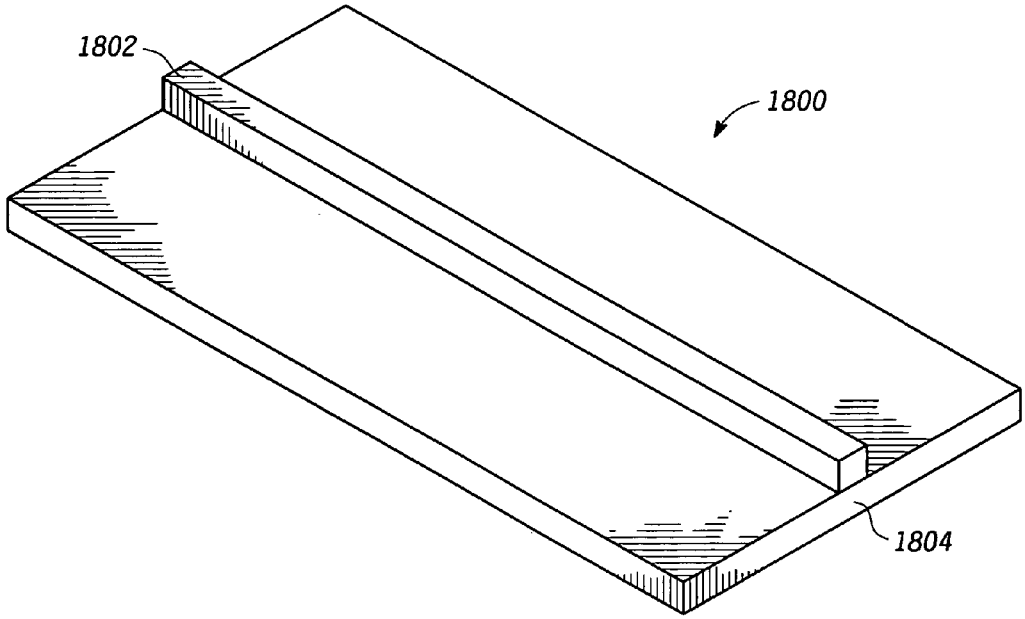
FIG. 35 is a perspective view illustrating an exemplary implementation of a microstrip transmission line disposed adjacent to a high-impedance surface in accordance with at least one embodiment of the present disclosure.

FIG. 35 illustrates an exemplary device 1800 having a microstrip line 1802 disposed at or near a high-impedance surface 1804. The inductance and capacitance of the high-impedance surface 1804 may be tuned so that the stop band of the high-impedance surface 1804 corresponds to the operating frequency of the microstrip line 1802 so that the combination of the microstrip line 1802 and the high-impedance surface 1804 acts as a type of transmission line filter. Such a transmission line filter generally displays a high reflection at frequencies at which the ground plane displays high impedance, thereby functioning as a stop band filter.

As discussed in detail above, the introduction of a high degree of capacitive coupling between the conductive structures as well as a high inductance per conductive structures for the exemplary conductive structures of the present disclosure can help reduce the dimensions of high impedance surfaces. To illustrate, for stop bands centered around 1–10 GHz, typical sizes of the disclosed high-impedance surfaces may be approximately 1–25 $mm^2$ with a thickness of 0.1–1 mm, sizes that are ideal for integration in an off-chip module. As such, the frequency selective high impedance surfaces may be used as ground planes for transmission line filters, as high reflectivity substrates for integrated antennas, for isolation, to aid in the realization of high-Q inductors, and to help significantly suppress propagation of the common-mode signal in differential transmission lines. Such implementations may be implemented in any of a variety of devices, including, but not limited to, wireless devices (e.g., mobile phones, pagers, portable digital assistants (PDAs)), notebook and desktop computers, test equipment, and the like.

Other embodiments, uses, and advantages of the invention will be apparent to those skilled in the art from consideration of the specification and practice of the invention disclosed herein. The specification and drawings should be considered exemplary only, and the scope of the invention is accordingly intended to be limited only by the following claims and equivalents thereof.

What is claimed is:

1. An apparatus comprising:

a first high-impedance surface;

a second high-impedance surface confronting the first high-impedance surface; and at least one inductor disposed between the first high-impedance surface and the second high-impedance surface.

2. The apparatus as in claim 1, wherein an operating frequency of the at least one inductor is within a stop band frequency range of the first high-impedance surface.

3. The apparatus as in claim 1, wherein the first high-impedance surface comprises one or more conductive structures having interleaved and overlapping conductive plates.

4. The apparatus as in claim 1, wherein the first high-impedance surface comprises a plurality of conductive structures, wherein a first conductive structure of the plurality of conductive structures comprises a conductive plate having one or more indentations at a first edge and a second conductive structure of the plurality of conductive structures comprises a conductive plate having one or more protrusions at a second edge, the one or more protrusions substantially coextensive with the respective one or more indentations of the first plate of the first conductive structure.

5. The apparatus as in claim 1, wherein the first high-impedance surface comprises a conductive structure comprising a conductive plate having a spiral pattern.

6. The apparatus as in claim 1, wherein the first high-impedance surface comprises one or more conductive structures, wherein at least a portion of at least one conductive plate has a spiral pattern.

7. An apparatus comprising:

a first high-impedance surface comprising a plurality of conductive structures, wherein a first conductive structure of the plurality of conductive structures comprises a conductive plate having one or more indentations at a first edge and a second conductive structure of the plurality of conductive structures comprises a conductive plate having one or more protrusions at a second edge, the one or more protrusions substantially coextensive with the respective one or more indentations of the first plate of the first conductive structure;

a first differential signaling transmission line adjacent to the high-impedance surface; and a second differential signaling transmission line adjacent to the first differential signaling transmission line and adjacent to the high-impedance surface.

8. The apparatus as in claim 7, wherein an operating frequency of the first and second differential signaling transmission lines is within a stop band frequency range of the high-impedance surface.

9. The apparatus as in claim 7, wherein the high-impedance surface comprises one or more conductive structures having interleaved and overlapping conductive plates.

10. The apparatus as in claim 7, wherein the first high-impedance surface comprises a conductive structure comprising a conductive plate having a spiral pattern.

11. The apparatus as in claim 7, wherein the first high-impedance surface comprises one or more conductive structures, wherein at least a portion of at least one conductive plate has a spiral pattern.

12. An apparatus comprising:

a first high-impedance surface;

a second high-impedance surface confronting the first high-impedance surface;

a first differential signaling transmission line disposed between the first high-impedance surface and the second high-impedance surface; and a second differential signaling transmission line disposed between the first high-impedance surface and the second high-impedance surface and adjacent to the first differential signaling transmission line.

13. The apparatus as in claim 12, wherein the first high-impedance surface comprises one or more conductive structures having interleaved and overlapping conductive plates.

14. The apparatus as in claim 12, wherein the first high-impedance surface comprises a plurality of conductive structures, wherein a first conductive structure of the plurality of conductive structures comprises a conductive plate having one or more indentations at a first edge and a second conductive structure of the plurality of conductive structures comprises a conductive plate having one or more protrusions at a second edge, the one or more protrusions substantially coextensive with the respective one or more indentations of the first plate of the first conductive structure.

15. The apparatus as in claim 12, wherein the first high-impedance surface comprises one or more conductive structures, wherein at least a portion of at least one conductive plate has a spiral pattern.

16. The apparatus as in claim 12, wherein an operating frequency of the first and second differential signaling transmission lines is within a stop band frequency range of at least one of the first high-impedance surface or the second high-impedance surface.

* * * * *